US009707151B2

(12) United States Patent
Woerlee et al.

(10) Patent No.: US 9,707,151 B2
(45) Date of Patent: Jul. 18, 2017

(54) LASER ALIGNMENT FOR AUTOMATED CPR DEVICE

(75) Inventors: Pierre Hermanus Woerlee, Valkenswaard (NL); Igor Wilhelmus Franciscus Paulussen, Nuenen (NL); Paul Aelen, Eindhoven (NL); Paul Franciscus Johannes Van Berkom, Tilburg (NL); Gerrit Jan Noordergraaf, Diessen (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 751 days.

(21) Appl. No.: 13/825,125

(22) PCT Filed: Sep. 12, 2011

(86) PCT No.: PCT/IB2011/053981
§ 371 (c)(1),
(2), (4) Date: Mar. 20, 2013

(87) PCT Pub. No.: WO2012/038855
PCT Pub. Date: Mar. 29, 2012

(65) Prior Publication Data

US 2013/0184618 A1 Jul. 18, 2013

(30) Foreign Application Priority Data

Sep. 20, 2010 (EP) ..... 10177652

(51) Int. Cl.
*A61H 31/00* (2006.01)

(52) U.S. Cl.
CPC ..... *A61H 31/00* (2013.01); *A61H 31/004* (2013.01); *A61H 31/006* (2013.01); *A61H 2201/0173* (2013.01)

(58) Field of Classification Search
CPC ..... A61H 31/00–31/02; A61H 2031/001–2031/025; A61H 2201/5092–2201/2094
See application file for complete search history.

(56) References Cited

U.S. PATENT DOCUMENTS 4,060,079 A 11/1977 Reinhold
4,082,090 A 4/1978 Harrigan
(Continued)

FOREIGN PATENT DOCUMENTS

CN 201073418 Y 6/2008
EP 1913924 A1 4/2008
(Continued)

OTHER PUBLICATIONS

American Heart Association Guidelines for Cardiopulmonary Resuscitation and Emergency Cardiovascular Care. Circulation. Dec. 13, 2005. vol. 112, Issue 24, part 4. http://circ.ahajournals.org/content/vol112/24_suppl/.

*Primary Examiner* — Rachel Young

(57) ABSTRACT

An automated cardiopulmonary resuscitation (ACPR) device includes a compression element for acting on a compression location on a chest of a patient, and an optical alignment aid configured and arranged for projecting, at least temporarily, a light pattern on the patient's chest. The light pattern projected by the optical alignment aid guides the user during the placement procedure of the ACPR device. The light pattern projected by the optical alignment aid allows the user to monitor whether the position of the automated cardiopulmonary resuscitation device has moved during the administration of CPR.

11 Claims, 3 Drawing Sheets

(56) References Cited

U.S. PATENT DOCUMENTS

| | | | | |
|---|---|---|---|---|
| 5,156,588 | A * | 10/1992 | Marcune | A61F 5/055 128/DIG. 23 |
| 5,738,637 | A * | 4/1998 | Kelly | A61H 31/005 601/135 |
| 5,823,185 | A * | 10/1998 | Chang | A61H 31/007 128/200.24 |
| 6,066,106 | A | 5/2000 | Sherman et al. | |
| 6,071,243 | A | 6/2000 | MacEachern | |
| 6,171,267 | B1 | 1/2001 | Baldwin | |
| 2004/0120467 | A1 | 6/2004 | Wollenweber | |
| 2004/0162510 | A1* | 8/2004 | Jayne | A61N 1/39 601/41 |
| 2004/0230140 | A1 | 11/2004 | Steen | |
| 2006/0018438 | A1* | 1/2006 | Sohal | A61B 6/08 378/206 |
| 2008/0119766 | A1 | 5/2008 | Havardsholm et al. | |
| 2009/0052760 | A1* | 2/2009 | Smith | A61N 5/1049 382/132 |
| 2009/0190722 | A1 | 7/2009 | Windt | |
| 2010/0156318 | A1* | 6/2010 | Quevedo | 315/294 |

FOREIGN PATENT DOCUMENTS

| | | | |
|---|---|---|---|
| JP | 2008119460 | A | 5/2008 |
| WO | 2010119401 | A1 | 10/2010 |

* cited by examiner

LASER ALIGNMENT FOR AUTOMATED CPR DEVICE

FIELD OF THE INVENTION

The field of the present invention relates to an automated cardiopulmonary resuscitation device which may be used to replace manual cardiopulmonary resuscitation and specifically the chest compressions.

DESCRIPTION OF THE RELATED ART

Sudden Cardiac Arrest (SCA) is one of the main causes of death in the western world. The resulting whole body ischemia after the SCA disturbs a wide range of cell processes, leading to severe cell damage and death unless acute medical care is available. It has been reported that the probability for survival after Sudden Cardiac Arrest decreases linearly with 3-7% per minute of arrest time.

Cardio-Pulmonary Resuscitation (CPR) can be performed whenever a patient suffers a Sudden Cardiac Arrest. A procedure consists of, but is not limited to, performing regular and rhythmic chest compressions to the sternum of the patient, at a rate of ca. 100 compressions per minute. Successful CPR requires that pressure is applied to the chest. It may be very difficult to administer consistent, high-quality manual chest compressions, with suitable pressures. Since CPR is key for survival, mechanical automated CPR devices (ACPR) have been developed to replace less reliable, frequently interrupted, difficult to control, and sometimes needed for long periods of time manual CPR. Trauma to the patient (anterior wall trauma, organ damage, broken xiphoid process, etc.) caused by CPR, may be an unavoidable, unique, negative cofactor in survival after resuscitation.

Different automated CPR apparatus have been introduced in the market. A first type of CPR apparatus uses techniques such as pneumatics to drive a compression rod with cup onto the chest of the patient. Another type of automated CPR is electrically powered and uses a large band around the patient's chest which contracts in rhythm in order to deliver chest compressions. The compression frequency is fixed and is controlled accurately such that high quality chest compressions can be achieved. Presently automated CPR (ACPR) systems such as the Michigan instruments Thumper/Live-Stat™ (U.S. Pat. No. 6,171,267), the LUCAS™ Devices (US Patent Application Publication No. 2004/0230140 A1), the Autopuls Device® (Zoll® Medical, U.S. Pat. No. 6,066,106 A) and a device by Laerdal (US Patent Application Publication No. 2008/0119766 A1) have been or will be introduced into the market, which is rapidly growing as caregivers come to realize their essence. Important issues in the current devices include long set-up times, low stability during operation of the device, as well as suggestions and clinical evidence that insufficient force is being applied for optimal performance. The place on the thorax where chest compressions are given may be of key essence to the success of CPR and relevant to limiting trauma. The ideal medial-lateral position is easy to find as the thorax is symmetrical around the medial plane. However, the cranial-caudal position is hard to find, especially when setting up an ACPR device, because initially the pad is far away from the chest which makes exact aiming difficult. The aiming is further compromised because the CPR pad is at a different location than the handgrips on the device.

In manual CPR there are different ideas on the ideal chest compression place. All agree that CPR should be administered in the middle of the medial-lateral plane (ref AHA guidelines 2005). In the cranial-caudal direction there are some differences. First there is the ⅓-⅔ rule, where one has to estimate the size of the patient's sternum (manubrium and corpus excluding the xiphoid-process). The ideal compression point is then at ⅓ of this distance, measured from caudal direction. This method was advised in the CPR guidelines 2000. In a second method, the hand should be placed with a space of the thickness of two fingers between the hand and the dimple at the lower thorax. In a third method the compression point is advised to be at the height of the inter-nipple line. The 2005 CPR guidelines advise placement of the heel of the hand "on the middle of the chest", and leave the precise compression place to the rescuer. It is suggested that this last method is faster and thus better as it causes less time loss. All methods agreed to certain extend: pushing cranially/high on the sternum is avoided because very large forces have to be applied on that place, the compression depth is small for relevant forces, and there is a high incidence of sternal fractures. Pushing too low on the sternum is avoided so inducing trauma by pushing on the xiphoid, which in turn can damage stomach, spleen or liver is avoided.

With one of the known CPR devices the compression pad is suggested to be placed at the height of the inter-nipple line. The known ACPR device comprises a backboard to which the compression pad (and any supporting structure for the compression pad, as the case may be) needs to be attached. The back board is applied beneath the patient and the patient covers the back board, often almost completely. Therefore, it is very difficult to see if the middle of the back board aligns with the inter-nipple line. The compression unit only fits in one way on the backboard, so that shifting is impossible in cranial-caudal direction with respect to the backboard. For adjusting the cranial-caudal position of the compression pad and the compression unit the backboard must be re-adjusted while it is under the patient, which is a difficult and lengthy procedure as the patient's scapula hinders movement of the backboard. The estimation of the correct compression point is also difficult because the compression point is at a distance from the backboard, especially on large patients, due to the patient's girth. During the process of attaching the ACPR device to the patient, no cardiopulmonary resuscitation can be performed, neither manually, nor automatically. This period is called a no flow time, because no blood flow can be induced within the patient during that time. A long attachment procedure means that the no flow time will be longer than desirable. Further, during CPR the pad is known to drift. When this is the case, a user should at least be able to determine, whether the pad stays in place during the CPR procedure or whether it has shifted so that the user may correct the compression pad's position.

Another known ACPR device provides an alignment reference on the backboard. The backboard of this known ACPR device is intended to be placed in such a manner that the arm pits are close to the reference line. However, the most common way to apply the backboard (lift the thorax of the patient up, and slide the board under the patient from the top side) makes the alignment very difficult as the patient and back board are under a (different) angle, the visibility of the alignment reference is poor, and the handling of the thick backboard is hard, the backboard can shift with respect to the patient and the definition of the armpit is fuzzy. Further, this kind of automated cardiopulmonary resuscitation device uses a band during CPR instead of a compression pad. This band is broad, making it possible to exceed force on the liver, spleen or xiphoid process. Further, it is difficult to see if the band is positioned perpendicular to the backboard. This problem is not a direct alignment issue, but it is related, since slight shifts of the band, which are known to occur regularly, may enlarge this problem.

For medical imaging devices, which are only very remotely related to automated cardiopulmonary resuscitation devices, it may be known to use optical alignment systems. For example, US Patent Application Publication No. 2006/0018438 A1 discloses a system and method for alignment of an object in a medical imaging device. Another optical alignment system and alignment method for radiographic X-ray imaging is disclosed in US Patent Application Publication No. 2009/0190722 A1.

SUMMARY OF THE INVENTION

It would be desirable to develop an automated cardiopulmonary resuscitation device that overcomes the problem of unknown compression pad location during application of an ACPR device and during ongoing resuscitation. It would also or alternatively be desirable to limit the time that it takes to align the compression device on the correct place on the patient. Another additional or alternative desire may be to reduce the number of the attempts that may be needed to place the compression unit correctly to have an as short as possible "no flow" time. It may also or alternatively be desirable to detect any shifting of the ACPR device during CPR which could lead to compressions at a non-optimal compression point.

In order to address at least one of these concerns and/or other concerns, an automated cardiopulmonary resuscitation device comprises a compression element for acting on a compression location on a chest of a patient and an optical alignment aid configured and arranged for projecting, at least temporarily, a light pattern on the patient.

The light pattern projected by the optical alignment aid guides the user during the placement procedure of the ACPR device. For example, the light pattern may allow the user to estimate the compression location at which he or she is aiming. The user may relate the light pattern to anatomical landmarks in order to direct the automated cardiopulmonary resuscitation device or the compression element to a substantially optimal compression location. Besides an anatomical landmark, the hand position of the Basic Life Support (BLS) rescuer might be used as reference. The fact that the light pattern is projected on the patient (which does not exclude that the light pattern may also be projected besides the patient) provides good visibility from those angles of view that a user may have during the placement of the automated cardiopulmonary resuscitation device. The light pattern projected by the optical alignment aid may also allow the user to monitor whether the position of the automated cardiopulmonary resuscitation device has moved during the administration of CPR.

There does not appear to be a public disclosure of an automated cardiopulmonary resuscitation device having an optical alignment system.

In one aspect of the invention the light pattern may be configured and arranged for providing a bearing of an aimed compression location during at least part of a placement procedure of the automated cardiopulmonary resuscitation device.

The bearing of the aimed compression point may directly indicate the aimed compression location by means of a special indicator that is part of the light pattern, but this is not necessary. The light pattern may hint at the aimed compression location, which may be useful since sometimes the aimed compression location is hidden beneath the compression element at least during the last phase of the attachment procedure. The term bearing may for example be understood as a homing aid that assists the user to home the desired compression location by bringing the aimed compression location in coincidence with the desired compression location.

In another aspect of the invention the optical alignment aid may be configured and arranged for being in a predefined spatial relation with respect to the compression element during at least part of placement procedure of the automated cardiopulmonary resuscitation device. A predefined spatial relation between the optical alignment aid and the compression elements allows the user to reliably and reproducibly use the optical alignment aid as a reference for the compression element and the compression location. The predefined spatial relation may comprise a relative position of the alignment aid with respect to the compression element, and/or an orientation of the optical alignment aid with respect to the compression element.

In another aspect of the invention the light pattern may comprise a line extending substantially in a medial-lateral direction on the chest of the patient. Thus the line of light indicates a certain cranial-caudal position on the chest of the patient. This temporary line will be drawn (on the chest) in medial-lateral direction by the optical alignment aid and will move together with the automated cardiopulmonary resuscitation device so that before, during and/or after application of the device the (aimed) compression point on the chest is evident. During the cardiopulmonary resuscitation the line may show if the compression point is still on a reference point (a landmark on the chest) that is desired by the rescuer. The line may be switched on/off for certain amounts of time during CPR.

In a further aspect of the invention the light pattern may comprise a cross so the centering of the patient in the backboard is guaranteed. The cross may comprise a first line extending substantially in the medial-lateral direction and a second line extending substantially in the cranial-caudal direction.

It would be desirable for the optical alignment aid to be small and to produce a clear light pattern that is well visible for the rescuer under a diversity of conditions. At least one of these concerns and/or possible other concerns are addressed by the optical alignment aid comprising a laser source. The laser source is usually capable of producing monochromatic light that is concentrated in a single beam. It is therefore suitable for producing a neat and clear light pattern on the chest of the patient. The light pattern may be produced from the laser beam by means of special lenses, mirrors, or other optical elements. It is also possible to produce a light pattern by means of a moving lens, a moving mirror, or a moving prism. Yet another possibility would be the use of special apertures or diffraction gratings. All these means for creating the light pattern may be summarized under the term "pattern creator".

In one aspect of the present invention the automated cardiopulmonary resuscitation device further may comprise a portal holding the compression element and the optical alignment aid.

In a further aspect of the teachings disclosed herein, the alignment aid may comprise at least two light sources located on both sides of the compression element. The two light sources may be arranged on both sides of the compression elements with respect to the medial-lateral direction. The presence of two light sources makes setup from both sides of the patient possible because substantially no part of the light pattern may be blocked by part of the compression pad and/or the patient. The portal maybe flipped over a back board and the two light sources project a composite light pattern on the chest of the patient that is visible from both sides of the patient as well as from angled cranial and caudal positions.

It would be desirable that the rescuer can monitor whether the compression element comes to rest on a desired compression location during the placement of the cardiopulmonary resuscitation device. This concern and/or possible other concerns are addressed by the automated cardiopulmonary resuscitation device further comprising a backboard. The portal may be arranged to attach to the backboard at at least two different positions spaced apart from each other in the cranial-caudal direction. By providing a backboard, the backboard may first be placed beneath the patient and then the portal may be advanced to the chest of the patient from above, i.e., substantially in an orthogonal direction with respect to the chest of the patient. Thus, the cranial-caudal position of the compression element substantially remains constant during a relevant phase of its placement. The cranial-caudal position of the compression element may be corrected because the portal attaches to the backboard at at least two different positions. It is possible to provide for a plurality of positions along the cranial-caudal directions or to provide an attachment mechanism that allows a continuous positioning of the portal with respect to the backboard in the cranial-caudal direction.

The backboard may comprise a locking rail and the portal may be arranged to attach to the locking rail at a plurality of positions along the cranial-caudal direction. The combination of the backboard and the optical alignment aid make fast and correct placement possible. This is because the compression unit can be placed on different places on the locking rail. According to an aspect of the automated cardiopulmonary resuscitation device the rail may be longer than the compression unit.

It would be desirable that the light pattern is well visible in all circumstances, even in bright sunlight. This concern and/or other possible concerns are addressed by the light projection comprising a wavelength between 440 nm and 570 nm and preferably between 530 nm and 560 nm. The indicated range of wavelength substantially covers the region from blue visible light to green visible light which provides a good contrast to all possible skin colors of humans and is therefore expected to be well visible. For example, lasers based on copper vapor (510.5 nm), Ar+ (514.5 nm), Nd:YAG (532 nm), Xe3+ (539.5 nm), He—Ne (543.5 nm), or semiconductor lasers may be used. The wavelength could also be between two of these disclosed exemplary wavelengths.

These and other aspects of the invention will be apparent from and illustrated with reference to the embodiment(s) described herein after.

DETAILED DESCRIPTION OF THE INVENTION

Figure 1:
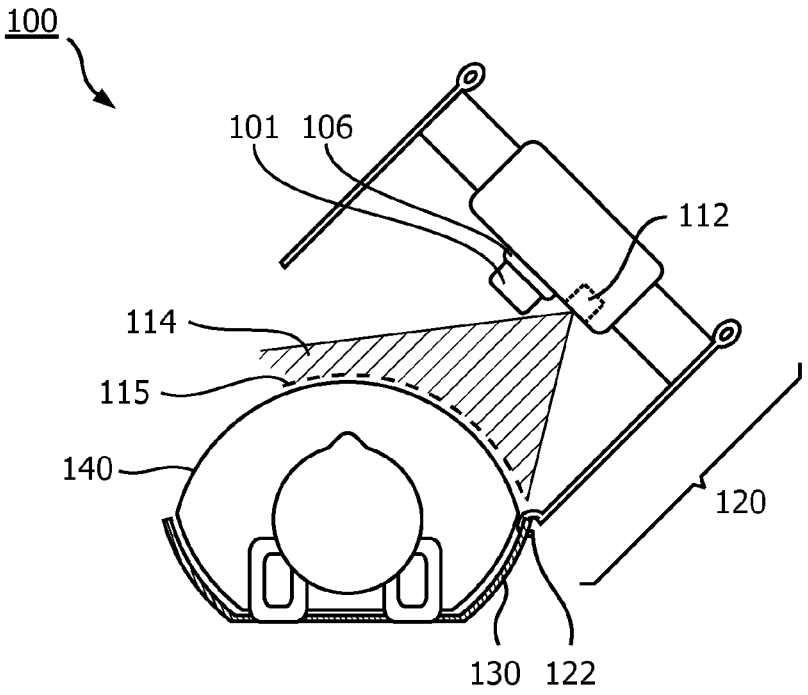
FIG. 1 shows a front view of an automated cardiopulmonary resuscitation device.

In FIG. 1 an automated cardiopulmonary resuscitation (ACPR) device 100, according to the teachings disclosed herein, is shown. The ACPR device 100 is shown in a front view during a placement procedure of the ACPR device 100 on a patient 140. The ACPR device 100 comprises a compression element 101 which is configured and arranged for exerting a mechanical force on a chest of the patient 140, preferably to the patient's sternum in a controlled but still forceful way. The compression element 101 is moved up and down when the ACPR device 100 is installed on the patient 140 and the patient is laid back down. The movement of the compression element 101 is provided by an actuator 106 which is schematically shown in FIG. 1 and other figures accompanying this description. The actuator is mounted to or within a portal 120. The portal 120 is configured and arranged for mounting to a backboard 130 by means of connectors 122, such as hinges, latches or the like. The portal 120 may be detachable from the backboard 130. In this manner, the patient 140 may first be placed on the backboard and the position of the patient 140 with respect to the backboard 130 may be carefully adjusted. For example, the patient's upper body may be propped up and then the backboard 130 may be placed against the patient's back and substantially maintained in this position while laying the patient 140 back stretched out on his/her back.

The ACPR device 100 further comprises an optical alignment aid 112. In the embodiment shown in FIG. 1 the optical alignment aid 112 is situated within a central portion of a cross bar of the portal 120. The optical alignment aid 112 is located adjacent to the compression element 101 and the actuator 106. Optical alignment aid 112 is configured and arranged for projecting a light pattern 115 on the patient. To this end, the optical alignment aid 112 produces a light emission 114 that is for example sharply delimitated for allowing a user to precisely asses the position of the light pattern 115 with respect to the chest of the patient 140. For example, the user may compare the light pattern 115 to an anatomical landmark on the patient's chest, such as the nipples, the sternum (if visible), the armpits, and the like. Another reference point may be the hand position of the BLS rescuer (see FIG. 7). The light pattern 115 may indicate an aimed compression location at which the compression element 101 is likely to come to rest and therefore apply mechanical force to the patient's chest. The optical alignment aid 112 and the compression element substantially move together as the portal 120 is installed on the back board 130. Thus, the light pattern projected by the optical alignment aid 112 assists the user in finding a good position of the portal 120 with respect to the backboard 130 during the placement of the ACPR device 100. It should be noted that the light pattern 115 needs not necessarily be present at the aimed compression location, because it is sufficient if the user can estimate the aimed compression location with sufficient accuracy.

The light pattern 115 may be temporarily generated by the optical alignment aid 112 during a placement of the ACPR device 100. The optical alignment aid 112 may be activated by the user via a control element (not shown), such as a button or switch. Automatic activation at power on of the ACPR device is another option. Further an automated movement check might be included by activating the light pattern a certain percentage of the time (e.g. 10 s every 5 min). These various options for activating the optical alignment aid may be combined in any manner.

The optical alignment aid 112 may comprise a light source and optical elements for producing the light pattern, for example lenses, masks, or apertures. It is also possible to use a laser source as the light source and to provide moving optical elements, such as mirrors, lenses, or prisms to dynamically deflect a laser beam produced by the laser source. By scanning the laser beam in a time-dependent manner it is possible to produce a light pattern 115 that is perceived as a steady light pattern by a human eye due to the rapidity of the scanning laser beam. For example, the laser beam may be deflected by a rotating mirror so that a line appears to be projected onto the patient's chest. The optical alignment aid 112 could comprise several light sources and/or light pattern creation devices for producing more complex light patterns 115. A possible implementation of the automated cardiopulmonary resuscitation device according to the teachings disclosed herein comprises a semiconductor laser as the light source and a diffraction element as the light pattern creation device.

In the embodiment shown in FIG. 1 the portal 120 is flipped onto the backboard 130 by pivoting the portal around the connector 122 which acts as a hinge. Thus the light pattern 115 will move from the right to the left during the placement of the portal. Note that the light pattern 115 remains substantially at its place in the cranial-caudal direction during the pivoting movement of the portal 120. As mentioned above, finding the correct position in the medial-lateral direction (i.e. the left-right direction in FIG. 1) is relatively easy to accomplish. Usually, the patient 140 is substantially centered on the backboard 130 and due to the connectors 122 the portal 120 is also substantially centered with respect to the patient 140 in the medial-lateral direction.

Figure 2:
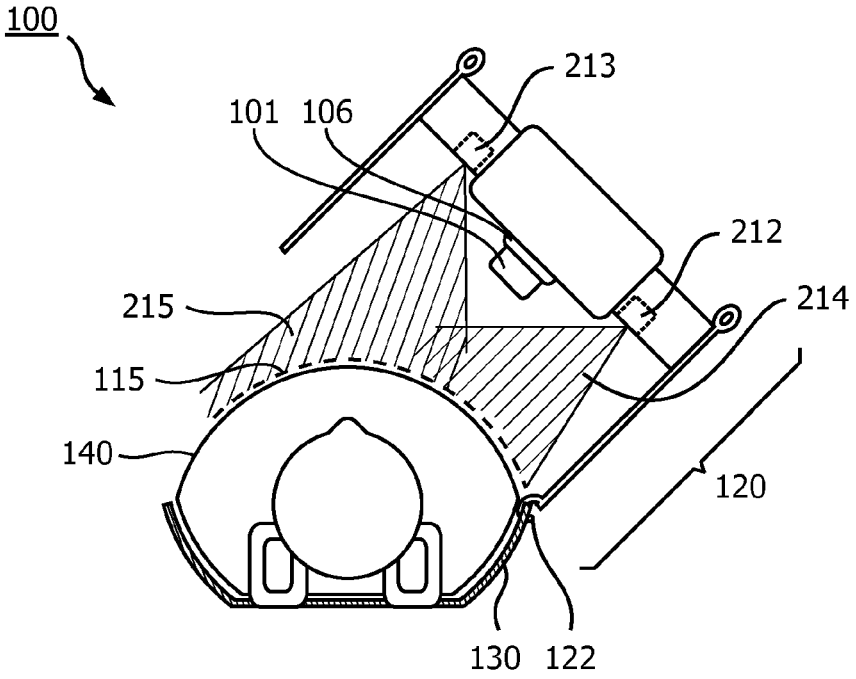
FIG. 2 shows a front view of an alternative version of an automated cardiopulmonary resuscitation device.

FIG. 2 shows another embodiment of an automated cardiopulmonary resuscitation device 100 according to the teachings disclosed herein. The ACPR device 100 shown in FIG. 2 differs from the ACPR device shown in FIG. 1 in that the optical alignment aid comprises two units 212, 213. The two units of the optical alignment aid 212, 213 are located within, or at, two side portions of the cross bar of the portal 120. The two units of the optical alignment aid 212, 213 could alternatively also be located in the central portion of the cross bar of the portal 120. The two units 212, 213 generate light emissions 214, 215 that conjointly form the light pattern 115 when projected onto the chest of the patient 140. With the two-unit optical alignment aid 212, 213, the light pattern 115 may cover a larger area on the chest of the patient. In particular the left side of the patient is now better covered by the light pattern 115 than with the embodiment shown in FIG. 1. Note that where the light emission 114, 214, or 215 follows a substantially tangential direction with respect to the curvature of the chest of the patient 140, the light pattern 115 may become faint and less clearly perceptible than where the light emission hits the chest at a more orthogonal angle. It could also be envisaged to move the units 212, 213 of the optical alignment aid further out on the cross bar of the portal 120 or to place them at or within the lateral stays or props of the portal 120.

Figure 3:
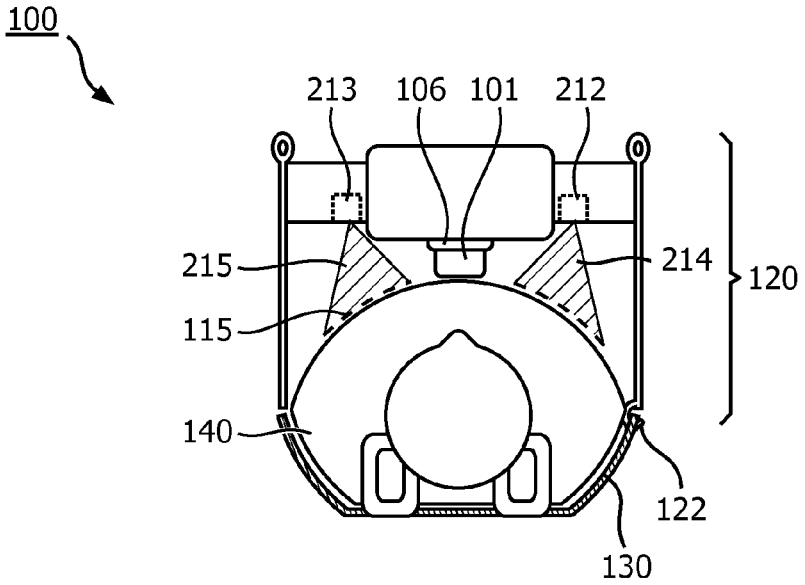
FIG. 3 shows a front view of the automated cardiopulmonary resuscitation device from FIG. 2 in a position ready for operation.

FIG. 3 shows the embodiment of the ACPR device 100 of FIG. 2 in an operation configuration, i.e., the portal having been brought to a final position in which it is thoroughly locked with the backboard. The cross bar of the portal 120 is in a substantially horizontal orientation. The compression element 101 is close to the chest of the patient 140 and may even touch it. Locking of the portal 120 with respect to the backboard 130 may be achieved by latches at the left side and/or the right side in the vicinity of connector 122. Latches or other means for locking the portal 120 with respect to the back board 130 are not shown in FIG. 3.

The two units 212, 213 of the optical alignment aid now produce separate light patterns 215 on either side of the compression element 101.

The light pattern 215 projected on either side of the compression element 101 allows a user to assess the position of the compression element 101 with respect to certain anatomical landmarks. The user may adjust the position of the portal 120 in the cranial-caudal direction based on the assessment. For example, the user could have determined that a good compression location would be 1 cm from the inter-nipple line in the caudal direction. Even though the aimed compression location will be obstructed by the compression element 101 during the last phase of the pivot motion of the portal 120, the light pattern 215 will still be visible and so will be the nipples. The user may complete the pivot motion of the portal 120 and then shift the portal in the cranial-caudal direction until the light pattern indicates that the compression location is indeed 1 cm from the nipples in the caudal direction. The user may than lock the relative position of the portal 120 and the backboard 130 by means of a suitable locking mechanism, such as latches, clamp-connections, screw-based connections, friction-based connections, or other types of connection.

Figure 4:
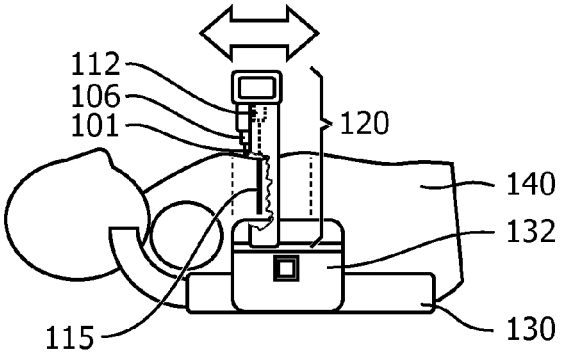
FIGS. 4 and 5 show possible configurations of the ACPR device.

FIG. 4 shows how the portal 120 is connected to the backboard 130 by means of a sliding rail 132. In FIG. 4 the portal is positioned in a substantially left position with respect to the sliding rail 132, i.e., almost at the most cranial position to which the portal 120 may be translated. The user may now notice that the light pattern 115 produced by the optical alignment aid 112 appears to be at a position that is well suited for the compression location. Accordingly, the user may choose to lock the portal 120 with respect to the sliding rail 132 so that no further relative movement of the portal 120 may occur in the cranial-caudal direction or in the anterior-posterior direction (such as pivoting around the connector 122 as shown in FIGS. 1 to 3).

Figure 5:
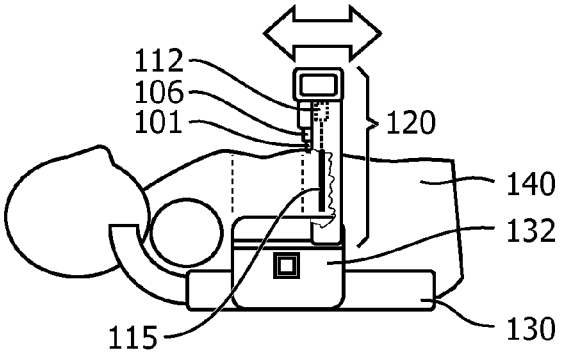

FIG. 5 shows a similar configuration as FIG. 4, but with the portal 120 placed at an extreme caudal position. When the user observes that the light pattern is too far offset from a suitable compression location in the caudal direction, the user may choose to shift the portal 120 back up in the cranial direction. The portal 120 may be locked to the sliding rail 132 in any position between an extreme cranial position and the extreme caudal position. In alternative embodiments it may be envisaged to provide a plurality of discrete locking positions.

Figure 6:
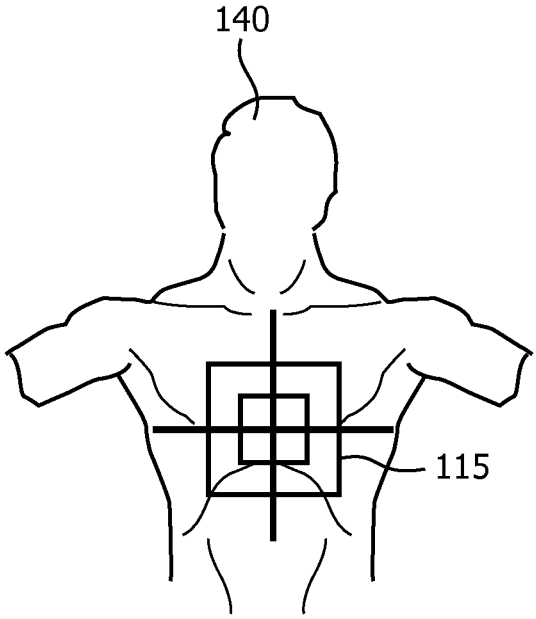
FIG. 6 shows an exemplary light pattern projected on the chest of a patient.

FIG. 6 shows the upper body of the patient 140 with an exemplary light pattern 115 projected onto his chest. The light pattern 115 comprises a horizontal line that indicates the position of the aimed compression location in the cranial-caudal direction. The light pattern 115 also comprises a vertical line that may assist the user in centering the ACPR device 100 with respect to the medial-lateral direction. The exemplary light pattern 115 further comprises two coaxial squares that are centered with respect to the aimed compression location. When the compression element 101 is already relatively close to the chest of the patient 140, the light pattern 115 may be intercepted or obstructed by the compression element 101. During this phase, the squares may provide some degree of orientation to the user. For example, the user may observe, whether the vertices of the squares move with respect to certain anatomical landmarks. A certain degree of movement is normal, because the squares (as well as the entire light pattern 115) tend to shrink as the portal 120 is approaching the chest of the patient 140. Nevertheless, the user should be able to detect any unwanted translation of the portal 120 and correct it during pivoting the portal 120. As mentioned above, fine adjustments in the cranial-caudal direction may be undertaken once the portal is in the horizontal position.

For a number of practical applications of ACPR devices a simple line drawn in the medial-lateral direction will be sufficient for assisting the user in properly placing the ACPR device 100.

Figure 7:
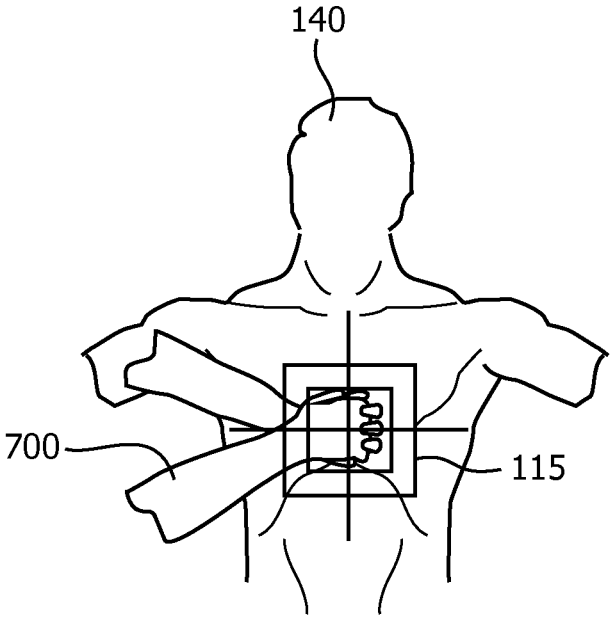
FIG. 7 shows the exemplary light pattern in relation to the hands of a BLS rescuer.

FIG. 7 is similar to FIG. 6 with the difference that the hands of a BLS rescuer are shown, as well. The hand position of the BLS rescuer may serve as a landmark during the placement of the ACPR device. The BLS rescuer may be able to feel the best position, for example while performing a number of manual compressions prior to the placement of the ACPR device.

Although the present invention has been described in connection with the specified embodiments, it is not intended to be limited to the specific form set forth herein. Rather, the scope of the present invention is limited only by the accompanying claims. In the claims, the term "comprising" does not exclude the presence of other elements or steps. Additionally, although individual features may be included in different claims, these may possibly be advantageously combined, and their inclusion in different claims does not imply that a combination of features is not feasible and/or advantageous. In addition, singular references does not exclude a plurality. Thus, references to "a", "an", "first", "second" etc. do not preclude a plurality. Furthermore, reference signs in the claims shall not be construed as limiting the scope.

The invention claimed is:

1. An automated cardiopulmonary resuscitation device comprising:

a compression element located on a cross-bar for acting on a compression location on a chest of a patient, wherein the compression element is operable for being moved by an actuator, and an optical alignment aid located on the cross-bar configured and arranged for projecting, at least temporarily, a light pattern on the patient, characterized in that the optical alignment aid is separate from the compression element and the actuator, wherein the optical alignment aid further comprises at least two light sources, wherein at least one light source of the at least two light sources is located on a first end of the cross-bar and a second light source of the at least two light sources is located on a second opposite end of the cross-bar, such that the compression element is located between the first and second light sources, the optical alignment aid further being configured and arranged to produce light emissions from the at least two light sources for projecting the light pattern that comprise (i) a user-viewable conjointly formed light pattern projected onto the patient in response to an initial pivoting placement of the compression element, actuator and optical alignment aid with respect to the patient, and (ii) separate user-viewable light patterns projected onto the patient in response to a final pivoting position and operation placement of the compression element, actuator and optical alignment aid with respect to the patient.

2. The automated cardiopulmonary resuscitation device of claim 1, wherein the light pattern is configured and arranged for providing a bearing of an aimed compression location during at least part of a placement procedure of the automated cardiopulmonary resuscitation device, wherein responsive to the initial pivoting placement, the light pattern comprises the user-viewable conjointly formed light pattern, and wherein responsive to the final pivoting position and operation placement, the light pattern comprises the separate user-viewable light patterns.

3. The automated cardiopulmonary resuscitation device of claim 1, wherein the optical alignment aid is configured and arranged to be in a predefined spatial relation with respect to the compression element during at least part of a placement procedure of the automated cardiopulmonary resuscitation device.

4. The automated cardiopulmonary resuscitation device of claim 1, wherein the light pattern comprises a line extending substantially in a medial-lateral direction on the chest of the patient, wherein responsive to the initial pivoting placement, the light pattern comprises a user-viewable conjointly formed line, and wherein responsive to the final pivoting position and operation placement, the light pattern comprises two separate user-viewable lines.

5. The automated cardiopulmonary resuscitation device of claim 1, wherein the light pattern comprises a cross, wherein responsive to the initial pivoting placement, the light pattern comprises a user-viewable conjointly formed cross, and wherein responsive to the final pivoting position and operation placement, the light pattern comprises two separate user-viewable light patterns.

6. The automated cardiopulmonary resuscitation device of claim 1, wherein the optical alignment aid comprises a laser source.

7. The automated cardiopulmonary resuscitation device of claim 1, further comprising a portal holding the compression element and the optical alignment aid.

8. The automated cardiopulmonary resuscitation device of claim 7, further comprising a backboard, wherein the portal is arranged to attach to the backboard at at least two different positions spaced apart from each other in the cranial-caudal direction.

9. The automated cardiopulmonary resuscitation device of claim 8, wherein the backboard comprises a locking rail and wherein the portal is arranged to attach to the locking rail at a plurality of positions along the cranial-caudal direction.

10. The automated cardiopulmonary resuscitation device according to claim 1, wherein the light projection comprises a wavelength between 440 nm and 570 nm.

11. The method of claim 10, wherein the light projection further comprises a wavelength between 530 nm and 560 nm.

* * * * *